US009743703B2

(12) United States Patent
Gotti

(10) Patent No.: US 9,743,703 B2
(45) Date of Patent: Aug. 29, 2017

(54) HELMET WITH VISOR

(71) Applicant: KASK S.r.l., Chiuduno (BG) (IT)

(72) Inventor: Angelo Gotti, Nembro (IT)

(73) Assignee: KASK S.R.L., Chiuduno (BG) (IT)

( * ) Notice: Subject to any disclaimer, the term of this patent is extended or adjusted under 35 U.S.C. 154(b) by 415 days.

(21) Appl. No.: 14/303,145

(22) Filed: Jun. 12, 2014

(65) Prior Publication Data

US 2014/0366253 A1 Dec. 18, 2014

(30) Foreign Application Priority Data

Jun. 18, 2013 (IT) ..... MI2013A1006

(51) Int. Cl.

| | |
|---|---|
| ***A42B 3/22*** | (2006.01) |
| ***A42B 1/00*** | (2006.01) |
| ***A42B 1/02*** | (2006.01) |
| ***A42B 1/08*** | (2006.01) |
| ***A61F 9/00*** | (2006.01) |
| ***A61F 9/06*** | (2006.01) |
| ***F41H 1/04*** | (2006.01) |
| ***A42B 3/04*** | (2006.01) |
| *A42B 3/06* | (2006.01) |

(52) U.S. Cl.

CPC ..... *A42B 3/223* (2013.01); *A42B 3/0406* (2013.01); *A42B 3/22* (2013.01); *A42B 3/221* (2013.01); *A42B 3/222* (2013.01); *A42B 3/227* (2013.01); *A42B 3/066* (2013.01)

(58) Field of Classification Search

CPC ..... A42B 3/223; A42B 3/066; A42B 3/22; A42B 3/222; A42B 3/0406; A42B 3/221; A42B 3/227

USPC ..... 2/424, 6.3, 6.5, 195.6, 8.3, 15, 6.7

See application file for complete search history.

(56) References Cited

U.S. PATENT DOCUMENTS

| | | | | | |
|---|---|---|---|---|---|
| 1,507,216 | A * | 9/1924 | Stockton | A41F 1/00 | 24/595.1 |
| 3,237,203 | A * | 3/1966 | Nielsen | A42B 3/225 | 2/10 |
| 3,315,272 | A * | 4/1967 | Olt | A42B 3/226 | 2/424 |
| 5,093,937 | A * | 3/1992 | Kamata | A42B 3/283 | 2/171.3 |
| 5,157,794 | A * | 10/1992 | Kamata | A42B 3/281 | 2/424 |

(Continued)

FOREIGN PATENT DOCUMENTS

| | | |
|---|---|---|
| DE | 29915934 U1 | 7/2000 |
| DE | 202005009186 U1 | 9/2005 |

(Continued)

*Primary Examiner* — Clinton T Ostrup
*Assistant Examiner* — Cameron A Carter
(74) *Attorney, Agent, or Firm* — Lucas & Mercanti, LLP

(57) ABSTRACT

Helmet with visor having a shell structure shaped is to at least partly cover the user's head. The visor is hinged to the opposite sides of the shell and mobile with respect to the shell between a raised position and a lowered position where it provides a protective extension of the helmet at the eyes of the user. The visor is manually switchable from the raised and lowered positions by using a magnetic coupling between the visor and the shell which guides and keeps the visor stable in the raised and lowered position and in a plurality of intermediate positions.

5 Claims, 4 Drawing Sheets

(56) References Cited

U.S. PATENT DOCUMENTS

| | | | | | |
|---|---|---|---|---|---|
| 5,987,640 | A * | 11/1999 | Ryder | G02C 3/02 | 2/10 |
| 7,540,033 | B2 * | 6/2009 | Kim | A42B 3/226 | 2/6.7 |
| 8,341,771 | B2 * | 1/2013 | Lee | A42B 3/226 | 2/15 |
| 2007/0136933 | A1 * | 6/2007 | Kim | A42B 3/226 | 2/424 |
| 2011/0154551 | A1 * | 6/2011 | Spink | A42B 3/223 | 2/10 |
| 2012/0047637 | A1 * | 3/2012 | Arnold | A42B 3/226 | 2/424 |
| 2012/0204330 | A1 * | 8/2012 | Albouy | A42B 3/145 | 2/421 |
| 2012/0291227 | A1 * | 11/2012 | Fiedler | A42B 3/04 | 24/3.3 |

FOREIGN PATENT DOCUMENTS

| | | | | |
|---|---|---|---|---|
| DE | 102006020134 | B3 | | 2/2008 |
| WO | 2012/047936 | A2 | | 4/2012 |
| WO | WO2012047936 | | * | 4/2012 |

* cited by examiner

HELMET WITH VISOR

CROSS-REFERENCE TO RELATED APPLICATION

The present application claims the priority of Italian patent application No. MI2013A001006, filed Jun. 18, 2013, the contents of which are incorporated herein by reference.

FIELD OF THE INVENTION

The present invention refers to a helmet with visor.

BACKGROUND OF THE INVENTION

Today, there are known a plurality of different types of helmets with visor comprising a shell structure shaped so as to at least partly cover the user's head and a visor hinged to the opposite sides of the shell and mobile with respect to the shell between a raised position, in which it does not protect the eyes of the user, and a lowered position, in which it provides a protective extension of the helmet at the eyes of the user.

The visor is manually switchable from the raised position to the lowered position and there are provided means for guiding and keeping the visor stable in the raised and lowered positions and in a plurality of intermediate positions.

SUMMARY OF THE INVENTION

Starting from such prior art, the object of the present invention is to provide a helmet with visor that is an alternative to the known ones, particularly simple and easy to make.

DETAILED DESCRIPTION OF THE INVENTION

Figure 1:
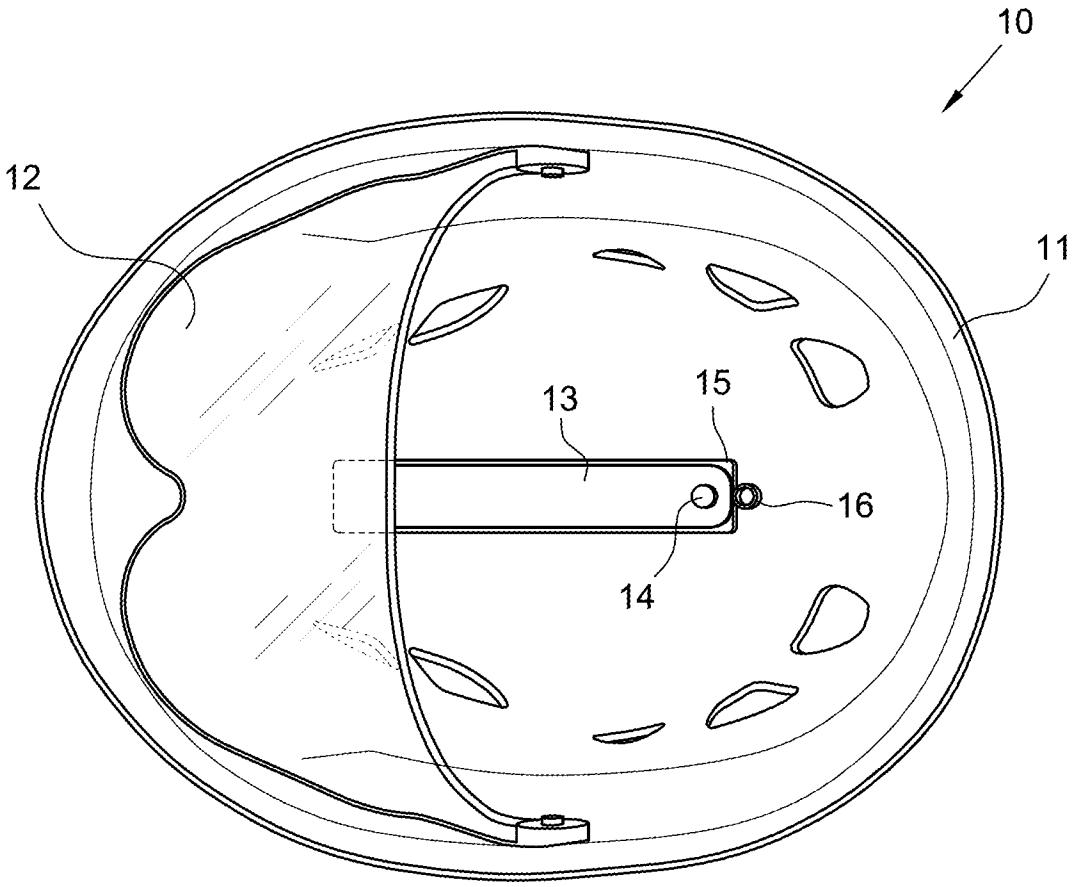
FIGS. 1-4 show possible configurations of the visor in a helmet according to the present invention.
Figure 2:
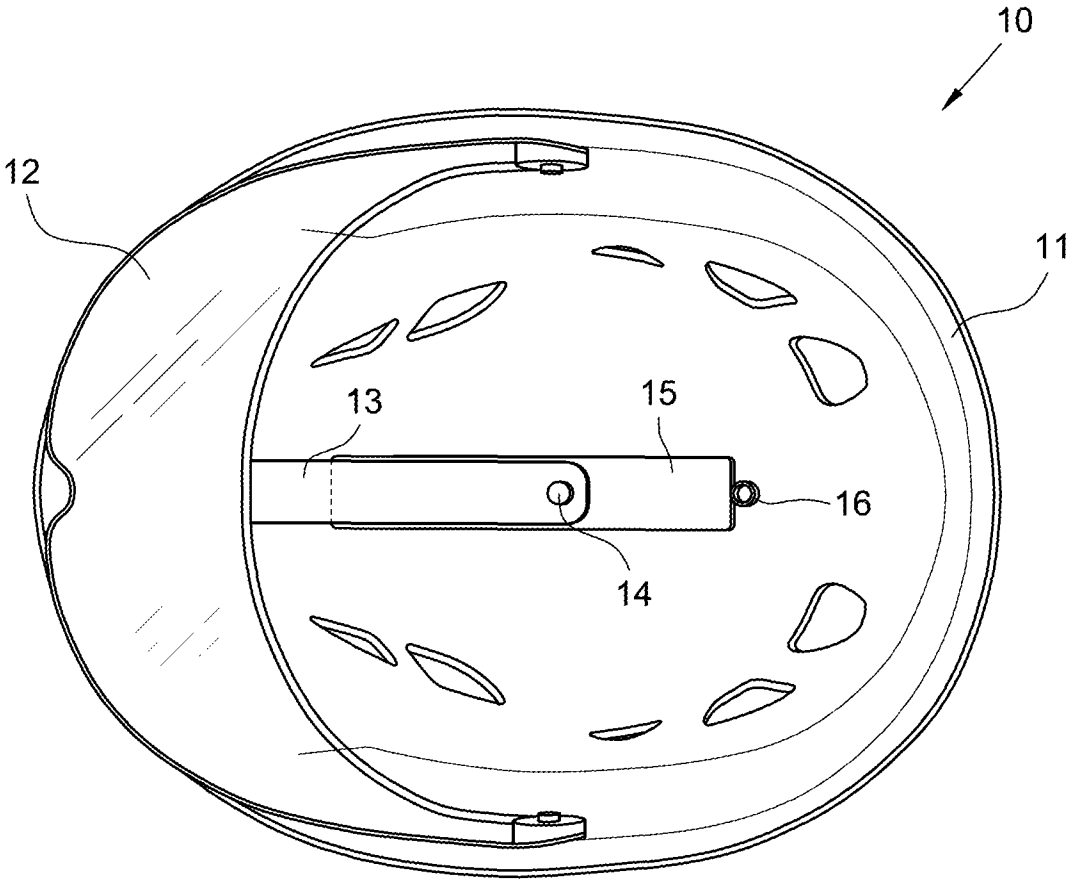
Figure 3:
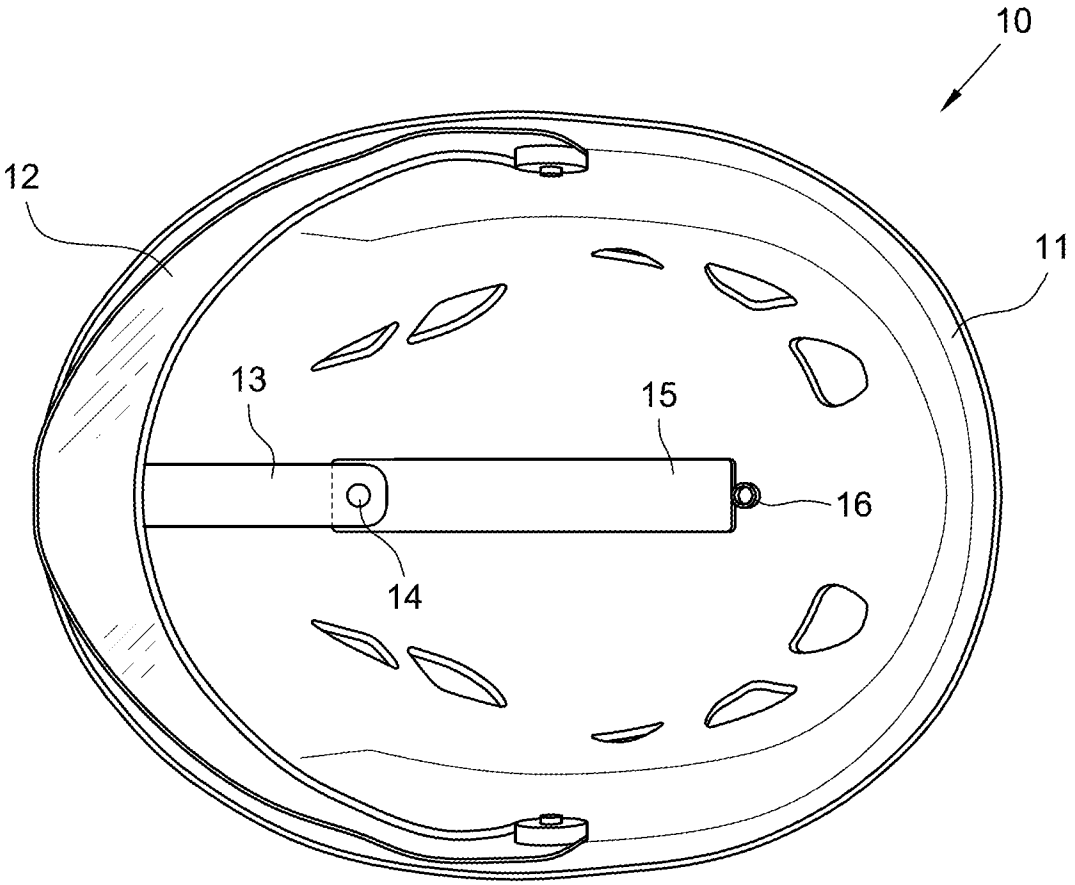
Figure 4:
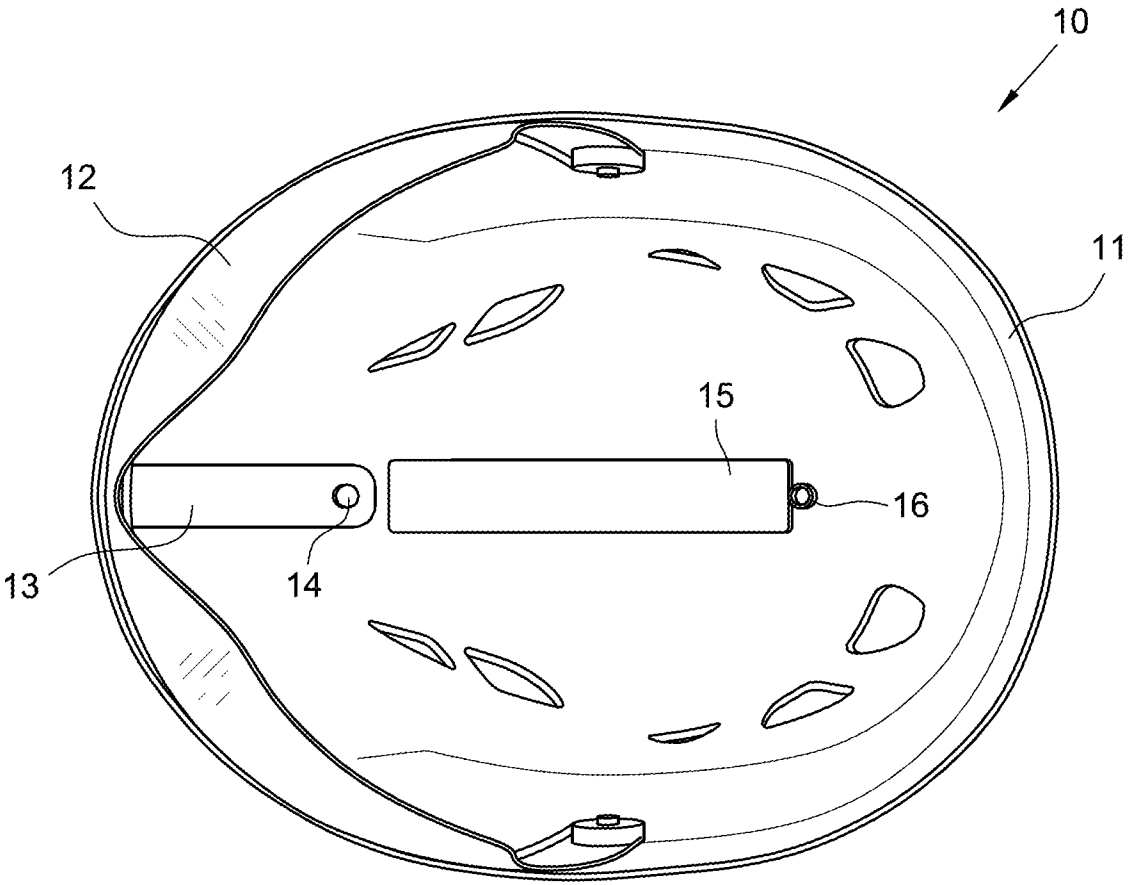

According to a main aspect of the invention, it is provided for that the means for guiding and keeping the visor stable in the raised and lowered positions and in a plurality of intermediate positions are obtained through a magnetic coupling between the visor and the shell.

Further characteristics of the invention are outlined by the dependent claims.

The characteristics and advantages of a helmet with visor according to the present invention shall be more apparent from the following exemplifying and non-limiting description with reference to the attached schematic drawings.

With reference to the figures, a helmet with visor according to the present invention is shown with 10.

Generally, the helmet may be of any type, both for sports activities and professional activities.

Such helmet 10 comprises a shell structure 11 shaped so as to at least partly cover the user's head and a visor 12 hinged to the opposite sides of the shell 11 and mobile between a raised position, in which it is superimposed to the shell 11 and it does not protect the eyes of the user, and a lowered position, in which it provides a protective extension of the helmet at the eyes of the user.

The visor 12 is manually switchable from the raised position to the lowered position and there are provided means for guiding and keeping the visor stable in the raised and lowered positions and in a plurality of intermediate positions.

According to the invention, such guide means comprise a magnetic coupling between the visor 12 and the shell 11 obtained, according to the shown example, from a rear extension 13 of the visor 12 provided with a magnetic portion 14, and a magnetic counter portion 15 obtained in the shell 11.

Preferably, both the magnetic counter portion 15 and the rear extension 13 are shaped like an elongated strip to ensure the magnetic coupling during the entire motion of the visor from the raised position to the lowered position.

According to two alternative embodiments, the magnetic counter portion made in form of a metal strip may be glued on the inner surface of the shell 11 or it may be integrated in a retractable manner inside the same.

Lastly, there may be provided an end stroke 16 for the motion of the rear extension 13 at the end of the magnetic counter portion 15 in distal position with respect to the visor 12 as well as an end stroke operating at the opposite end of the magnetic counter portion 15.

These end strokes limit the motion of the visor from the raised position to the lowered position.

It has thus been observed that a helmet with visor according to the present invention attains the previously outlined objects.

Actually, the helmet with visor of the present invention provides a solution alternative to the currently known helmets with innovative means for guiding and keeping the visor in position.

The helmet with visor of the present invention thus observed can be subjected to numerous modifications and variants, all falling within the same inventive concept; in addition, all elements can be replaced by technically equivalent elements. In practice, the materials used, as well as the dimensions thereof, may vary according to the technical requirements.

The invention claimed is:

1. Helmet with a visor, wherein said helmet comprises a shell structure shaped to at least partially cover a user's head;

said visor being hinged at opposite sides of said shell and mobile with respect to said shell between a raised position, in which said visor is laid on top of said shell and does not protect the user's eyes, and a lowered position, in which said visor is configured to offer a protective extension of the helmet at the user's eyes, said visor being manually switchable between said raised position and said lowered position, wherein guide means for guiding said visor and for keeping said visor stable in the raised, lowered and a plurality of intermediate positions are provided, said guide means comprising a rear extension formed on said visor with a magnetic portion and a magnetic counter-portion formed in said shell, said guide means forming a magnetic coupling between said visor and said shell, both said rear extension and said magnetic counter-portion are shaped as an elongated strip to ensure the magnetic coupling is constantly formed during an entire motion of the visor from said raised position to said lowered position.

2. Helmet with visor according to claim 1, wherein said magnetic portion is arranged at a free end of said rear extension.

3. Helmet with visor according to claim 2, wherein a first end stroke is provided for said rear extension at an end of said magnetic counter-portion in a distal position with respect to said visor to lock it in raised position.

4. Helmet with visor according to claim 1, wherein said magnetic counter-portion is made in the form of a metallic strip glued onto the inner surface of said shell.

5. Helmet with visor according to claim 1, wherein said magnetic counter-portion is made in the form of a metallic strip integrated in a retractable manner inside said shell.

* * * * *